United States Patent [19]

Johnson

[11] 4,351,490

[45] Sep. 28, 1982

[54] POWER DRIVE STRUCTURE FOR ROTATING THREADEDLY SUPPORTED ROCK CRUSHER BOWLS

[76] Inventor: Louis W. Johnson, 2435 Prairie Rd., Eugene, Oreg. 97402

[21] Appl. No.: 140,728

[22] Filed: Apr. 16, 1980

[51] Int. Cl.[3] ..... B02C 2/04

[52] U.S. Cl. ..... 241/286; 241/207

[58] Field of Search ..... 241/37, 207, 286, 290

[56] References Cited

U.S. PATENT DOCUMENTS

| | | | |
|---|---|---|---|
| 3,542,301 | 11/1970 | Trifonov et al. | 241/286 X |
| 3,688,995 | 9/1972 | Kueneman et al. | 241/207 |
| 3,759,453 | 9/1973 | Johnson | 241/286 X |
| 3,797,759 | 3/1974 | Davis et al. | 241/286 X |
| 4,192,472 | 3/1980 | Johnson | 241/286 X |

*Primary Examiner*—Howard W. Goldberg
*Attorney, Agent, or Firm*—Eugene M. Eckelman

[57] ABSTRACT

An upright frame is secured to the base member of a rock crusher and supports a slide bar for horizontal movement. A fluid-operated cylinder is connected between the upright frame and the slide bar for driving the latter longitudinally in both directions, and a pivotal driver is mounted on the slide bar for movement into and out of engagement with projections on the crusher bowl. A second fluid-operated cylinder is connected between the slide bar and the driver for pivoting the latter between an inner engaging position with the projections and an outer release position. By suitable operation of the two fluid-operated cylinders, the bowl can be rotatably driven on threads on the base member for installing it and removing it. An upright extension is attachable to the slide bar and carries an auxiliary driver thereon disposed above the main driver so as to engage the projections on the bowl when such projections are above the plane of the main driver such as when installing or removing the bowl. A jam nut is employed to lock the bowl non-rotatably on its base member and such jam nut is driven by a fluid operated cylinder having adjusted mounted positions for repositioning such cylinder in the event of thread wear.

9 Claims, 10 Drawing Figures

POWER DRIVE STRUCTURE FOR ROTATING THREADEDLY SUPPORTED ROCK CRUSHER BOWLS

This invention relates to new and useful improvements in rock crushers and more particularly pertains to power driven structure for rotating the bowl portion of the rock crusher to install, remove, or adjust such bowl portion.

Rock crushers of the gyratory type have an annular bowl which serves as the receiving portion for base material to be crushed and which is associated with an inner mantle for accomplishing the crushing operation. The bowls in this type of structure have a threaded support on the base portion of the crusher, and for installing and removing the bowl it must be rotated relative to the base. The bowl, due to its heavy mechanical construction and also due to a galling effect that may occur in the threads, usually cannot be rotated manually, at least from a set position after the crusher has been in use, and definitely cannot be rotated manually while the machine is crushing.

SUMMARY OF THE INVENTION

According to the present invention and forming a primary objective thereof, novel powered drive means are provided between the base member and the bowl for driving the bowl rotatably. More particular objects of the invention are to provide an apparatus of the type described which is simplified in structure and rugged in operation, and which provides an efficient drive on the annular bowl for rotating the latter even while the machine is is crushing operation.

Another object is to provide jam nut means arranged to hold the bowl in a non-rotative position relative to the base member in the use position of the crusher, such jam nut means including a fluid-operated cylinder which has one or more mounted positions on the base member to adjust for thread wear of the bowl support.

In carrying out the above objectives, an upright frame is secured to the base member of the crusher and a slide bar is supported on said upright frame for horizontal slidable movement. First fluid-operated cylinder means is connected between the upright frame and the slide bar for driving the latter longitudinally in both directions. A driver is pivotally mounted on the slide bar which is arranged for movement into and out of engagement with projections on the bowl for rotating the bowl. Second fluid-operated cylinder means is associated with the driver for moving such driver into and out of engagement with the projections. The invention also includes an easily mountable and demountable upright extension frame securable to the slide bar which projects above the latter. This extension frame supports a pivotally mounted auxiliary driver arranged for engagement with the projections on the bowl in an initial upper position of the bowl wherein the projections are above the plane of the lower driver. Jam nut means are employed between the threads of the bowl and above the threads on the base member so as to provide a non-rotative connection between these two members when the threads of the bowl are forcefully jammed. The jam nut means is powered by a fluid-operated cylinder, and such cylinder has one of more mounted positions on the base member for varying the drive stroke thereof.

DETAILED DESCRIPTION OF A PREFERRED EMBODIMENT

Figure 8:
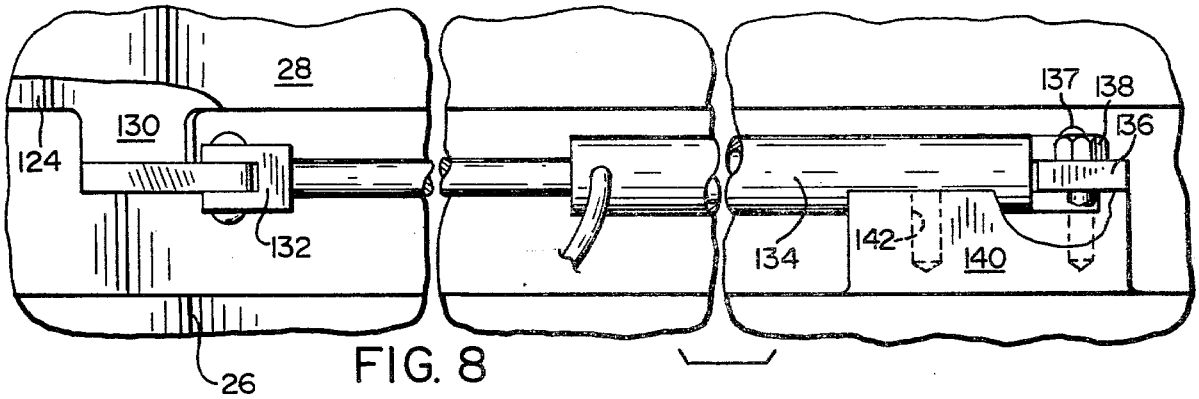
FIG. 8 is an enlarged, foreshortened side elevational view taken on the line 8—8 of FIG. 7.

The present invention is associated with a rock crusher of the type having an annular bowl 10, FIGS. 1, 2, and 3, with a hopper portion 12, FIG. 1, and an inturned flange 14 below its upper edge which supports a liner 16 by means of eye bolts 18 in a conventional manner. Liner 16 is associated with a crusher head and other mechanism, not shown, operative in rock crusher functions.

Bowl 10 has a vertical threaded connection 22 with a bowl nut 24 which forms a part of the base member of the crusher. This threaded connection includes thread liners 25 constructed of a non-metallic low coefficient of friction bearing material. These thread liners are secured to the threads on the bowl nut 24 and take the upward thrust of the bowl 10 during crushing operations as well as serving as bearing surfaces when the crusher is being adjusted rotatably. Such liners prevent seizing of the threads by galling or corrosion. The bowl nut 24 has a peripheral flange portion 26 with a flat top surface, and the bowl 10 has an annular angular housing 28 bolted thereto, the peripheral portion of such housing having evenly spaced vertical projections or lugs 30 secured thereon.

Power drive means of the invention for rotating the bowl 10 comprises an upright frame 32 consisting of end supports 34 and 36 having integral foot portions 38 arranged to be secured suitably, such as by bolts 40, to the top surface of the flange portion 26 of the bowl nut. End supports 34 and 36 include a pair of parallel bar-like members secured together at a lower portion thereof by a longitudinal reinforcing and connecting frame member 42. This frame member is secured, as by welding, between the two bar-like members and has intermediate supports 43 also with foot portions 38. It has a suitably contoured bottom edge 44 to accommodate other crusher parts.

Upright frame 32 is straight in its longitudinal configuration, and if its length requires that one end thereof project outward beyond the edge of the bowl nut, an outrigger 46 at such projecting end can be used for reinforcement. Outrigger 46 preferably is integral with the frame 32, as by welding, and bolted to the bowl nut.

Figure 6:
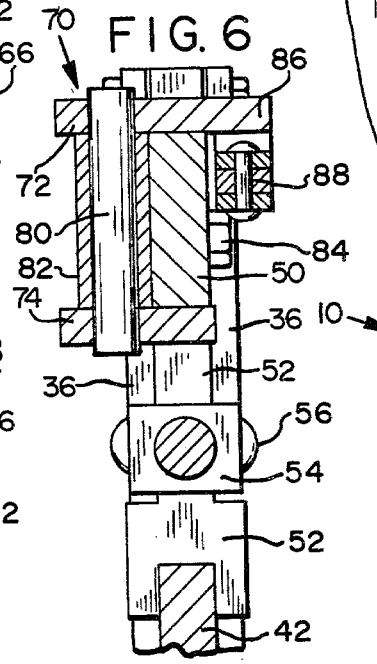

Slidably mounted between the end supports 34 and 36 adjacent an upper portion thereof is a slide bar 50 having a depending ear 52 intermediate its ends with a bifurcated bottom end, FIG. 6, which has a straddling support on frame member 42. One end of a fluid-operated cylinder 54 is connected to the ear 52 by means of a pivot connection 56, and the other end of the cylinder 54 is secured to the end supports 34 by a pivot connection 58. The cylinder 54 is disposed directly under the slide bar with the end at the pivot connection 58 projecting between the two members 34.

Figure 4:
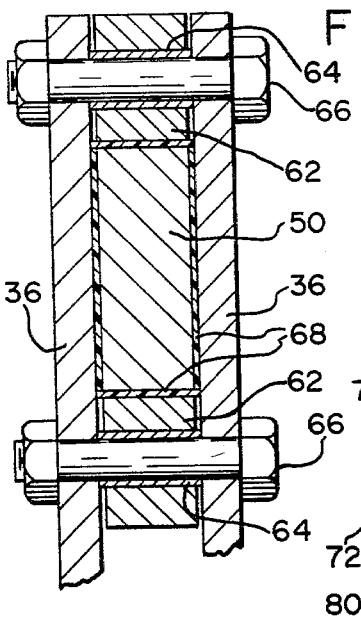
FIGS. 4, 5 and 6 are enlarged fragmentary section views taken on the lines 4—4, 5—5, and 6—6 of FIG. 2, respectively.

As best seen in FIG. 4, bar 50 has longitudinal slidable support between upper and lower shoes 62 in turn mounted on sleeves 64 supported pivotally on bolts 66 secured between the pairs of end supports. Shoes 62 have clearance between the end supports for free pivotal movement and the sleeves 64 are of sufficient length to act as spacers to maintain such clearance. Bearing liners 68 of a suitable material, such as lubricating plastic, are disposed between the slide bar 50 and its confining parts, such liners preferably being secured to the inwardly directed surfaces of the members 34, 36, and 62 by a suitable adhesive.

Conventional control means, not shown, are employed for operating the cylinder 54 in both directions.

Slide bar 50 is arranged in its powered movement to rotate bowl 10, and a drive connection between such bar and the bowl is accomplished by a driver 70, FIGS. 1-3, 5 and 6, having a body member constructed of a top plate 72 and a bottom plate 74 interconnected integrally by a pair of cross webs 76 extending therebetween and disposed with their facing edges a distance apart which is slightly greater than the diameter of the projections 30. Plates 72 and 74 are recessed between the facing edges of the webs 76 so that socket portions will be formed between such webs for receiving the projections 30.

The end of the driver 70 opposite from the socket end has a pivot connection 80 on a lateral extension 82 suitably secured to the side of the bar 50, as by bolts 84. Extension 82 is mounted on the bowl side of the bar 50, and the top plate 72 of the driver has a lever arm portion 86 projecting on the opposite side of the bar from the extension 82 and having a pivot connection 88 with one end of a fluid-operated cylinder 90 having a pivot connection 92 at its opposite end with an ear 94 projecting integrally from a side of the slide bar 50. By suitable operation of cylinder 90, the driver 70 can be moved into engagement with projections 30 or it can be moved out of the plane of rotation of the projections. Conventional control means, not shown, are provided for operating the cylinder 90.

When it is desired to power rotate the bowl 10, such as when it is to be tightened down on the bowl nut or when it is to be loosened, driver 70 is pivoted inwardly into engagement with one of the projections 30 by suitable operation of the cylinder 90 and the cylinder 54 then operated to drive the slide bar 50 longitudinally in a desired direction which is turn rotates the bowl. After a drive step has been accomplished, the driver 70 is swung outwardly by means of the cylinder 90 and the slide bar 50 retracted by the cylinder 54 to engage a succeeding projection 30 for another drive step. The structural arrangement shown and described, comprising the slide bar 50 supported slidably between the end uprights, the specific construction of the driver 70 employing body members disposed above and below the bar 50, and the support of the cylinder 54 directly under the slide bar, makes for a compact, simplified, and rugged structure. In addition, the slide bar and associated structure are disposed close to the bowl to provide an efficient tangential drive on the bowl. Powered adjustment of the bowl can be accomplished if desired while the crusher is in operation. Although only one bowl drive mechanism is illustrated herein, it is preferred that two of such mechanisms be provided in diametrical alignment.

Figure 9:
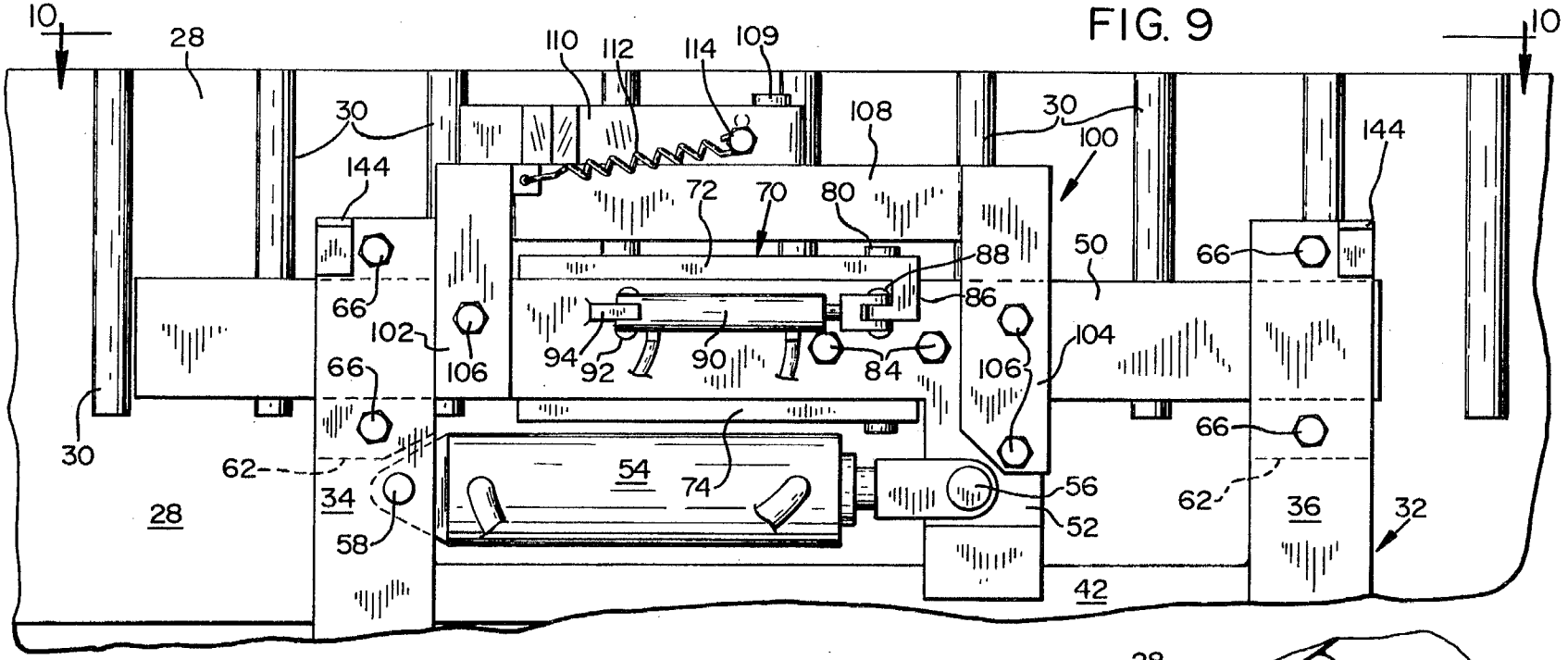
FIG. 9 is a side elevational view taken similar to FIG. 2 but showing a drive extension attached to the crusher.
Figure 10:
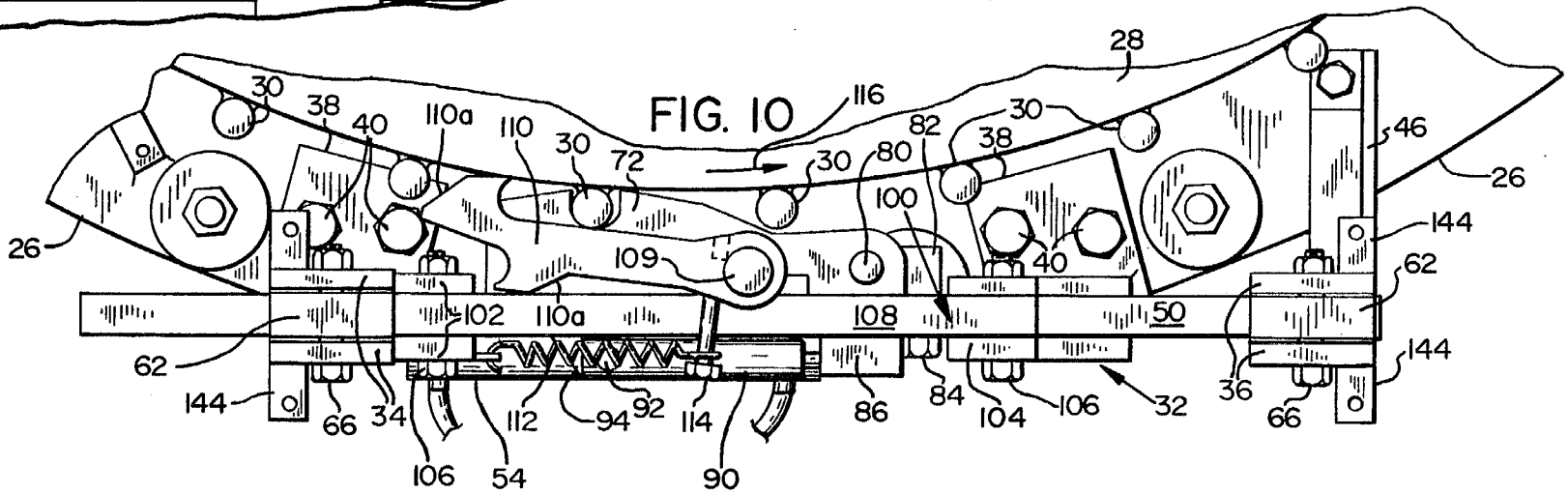
FIG. 10 is a top plan view taken on the line 10—10 of FIG. 9.

In an upper position of the bowl 10, such as when the bowl is being initially lowered into place, or when it is being removed the projections 30 may be in a plane above the driver 70 and it may be desired that powered rotation at this initial stage be available. For this purpose, the slide bar 50 is provided with a vertical extension 100, FIGS. 9 and 10, employing pairs of end uprights 102 and 104 straddling the bar 50 at their lower ends and bolted thereto by bolts 106. The uprights 102 and 104 are connected integrally to each other by a longitudinal frame member 108 welded in place between the uprights, and this frame member includes a pivot support 109 for a driver 110 on its top edge which can be used either for a push or pull function. Driver 110 comprises a pawl which is spring biased toward the bowl 10 by a tension spring 112 connected at one end to one of the uprights 102 and at its other end to a lever arm 114 threadedly secured to the pawl. The pawl as shown in FIGS. 9 and 10 is installed to rotate the bowl 10 in a pulling function in the direction of arrow 116 as viewed in FIG. 10 upon driving movement of the slide bar 50. To rotate the bowl in the opposite direction, pawl 110 is turned over and its spring lever bolt 114 transferred to a threaded mounting on the other side. When in this latter position, the pawl will push instead of pull. The pawl 110 is made with a ramp or cam edge **110*a* on each side to ride over the projections 30 when the pawl returns with the slide bar 50** for a new grip.

As stated, the extension 100 and its pawl are primarily used to start the threaded rotation of the bowl down on the bowl nut 24 or to remove the bowl from the threads. Assembly 100 is not intended to be used for normal adjustment of crusher setting and generally will be removed except when installing and removing the bowl.

It is necessary to firmly jam or lock the threaded engagement between the bowl 10 and the bowl nut 24 to maintain desired crusher adjustment and to resist destructive movement during crushing operations. For this purpose, and annular jam nut 120, FIG. 1, seats on the top edge of the bowl nut 24 and threadedly engages the threads of the bowl. A non-metallic low coefficient of friction bearing washer 122 is disposed between the jam nut 120 and the bowl nut 24, and the thread liners 25 also extend up into the threads between the jam nut and the bowl. An upright sleeve 124 is secured, as by welding, to the outer peripheral surface of jam nut 120 with portions thereof projecting above and below the jam nut. Sleeve 124 fits inside of angular housing 28 and has a combination bearing and dust seal 126 disposed between these overlapping portions and secured to the member 28. The overlapping feature of angular housing 28 with relation to the sleeve 124 protects the latter from dirt.

Figure 7:
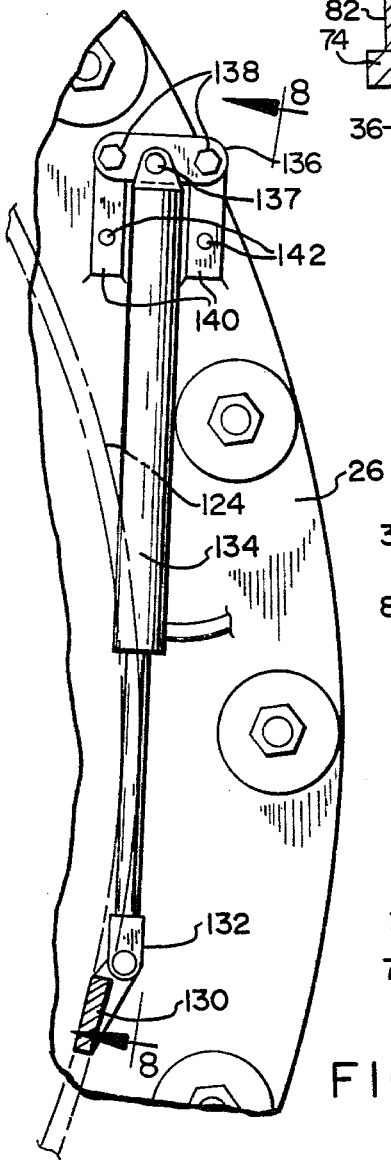
FIG. 7 is a top plan view of jam nut drive means as installed on the crusher.
Figure 5:
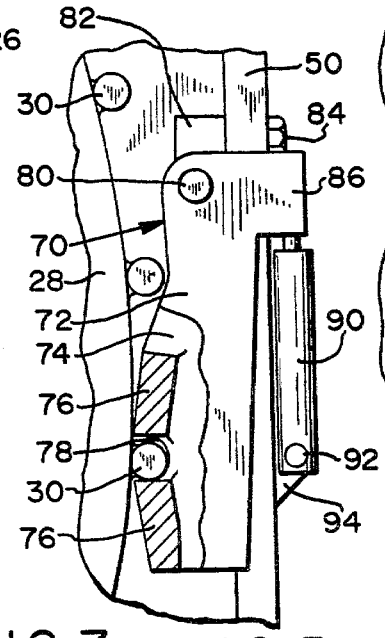

With reference to FIGS. 7 and 8, jam nut 120 has a depending lug 130, and this lug has a pivot connection 132 with one end of a fluid-operated cylinder 134 having its other end connected to a cross link 136 by a pivot connection 137. Link 136 in turn has screw connections 138 on parallel base portions 140 having two or more threaded holes 142 along their length arranged to receive the screws 138 so that the cylinder can have two or more mounted locations on the bowl nut 24. By means of this adjustment, the cylinder can be repositioned in the event of thread wear so that the jam nut 120 can be tightened without the piston bottoming out. The drive means of the jam nut are suitably located around the bowl from the bowl drive mechanism and may include two of them in diametrical alignment.

Figure 1:
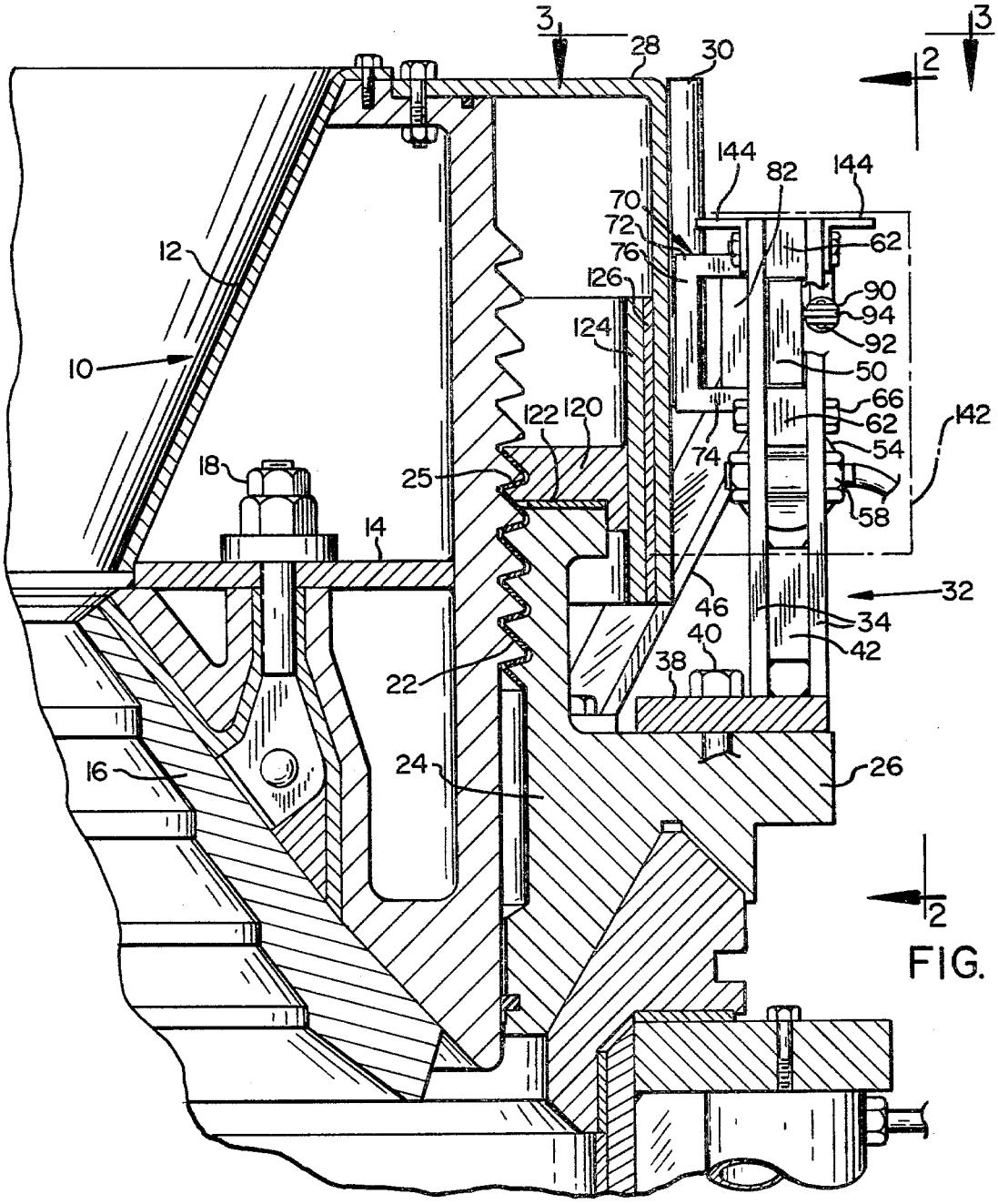
FIG. 1 is a fragmentary vertical sectional view taken radially through a rock crusher employing a bowl threadedly supported on the crusher and further showing in end elevation a power driven structure for rotating the bowl according to the present invention, this view being taken on the line 1—1 of FIG. 2.
Figure 2:
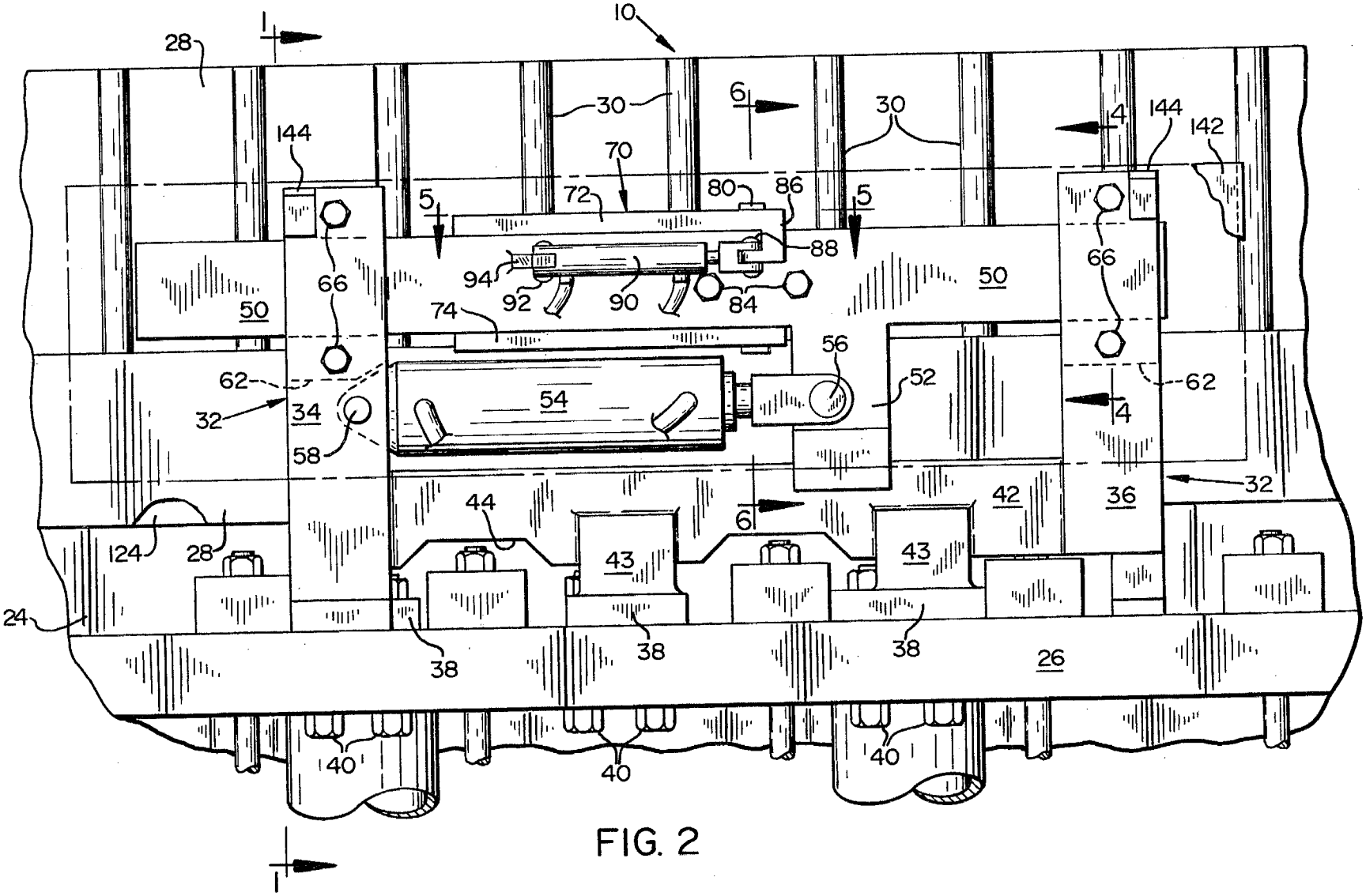
FIG. 2 is a side elevational view of the power driven rotating structure of the present invention, this view being taken on the line 2—2 of FIG. 1.
Figure 3:
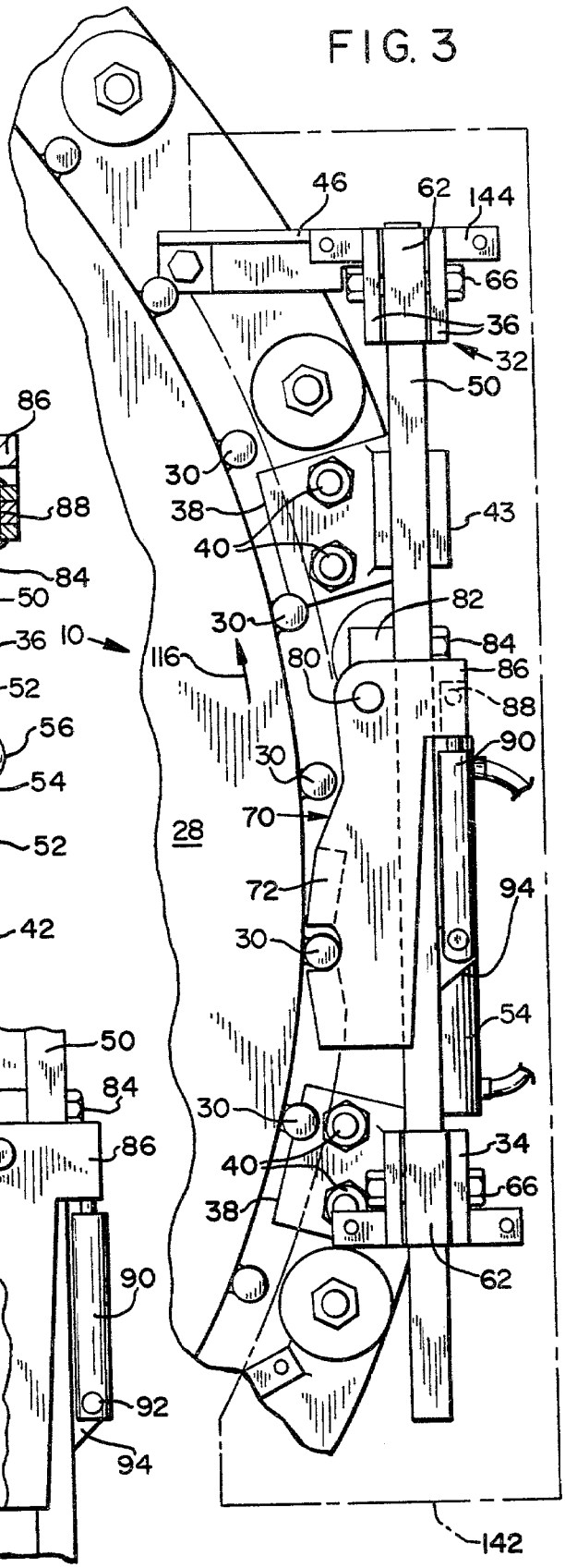
FIG. 3 is a fragmentary top plan view taken on the line 3—3 of FIG. 1.

A protective shield 142, which is shown in broken lines in FIGS. 1 and 3 and mostly broken away in FIG. 2, is mounted on brackets 144 integral with the end supports 34 and 36. It is removed when the extension 100 is used but is reinstalled when said extension is removed.

It is to be understood that the form of my invention herein shown and described is to be taken as a preferred example of the same and that various changes in the shape, size and arrangement of parts may be restored to without departing from the spirit of my invention, or the scope of the subjoined claims.

Having thus described my invention, I claim:

1. A power driven bowl rotating mechanism for use with rock crushers of the type having a base member and a bowl threadedly supported on the base member whereby upon rotation thereof the bowl is arranged to be raised or lowered, the bowl being of the type which has a plurality of projections secured in spaced relation around the periphery thereof, said power driven bowl rotating mechanism comprising (a) an upright frame arranged to be secured to the base member of a crusher, (b) a slide bar supported on said upright frame for horizontal slidable movement, (c) first double acting means connected between said upright frame and said slide bar and arranged to drive said slide bar longitudinally in reciprocating movement, (d) driver means pivotally mounted on said slide bar arranged for movement inwardly and outwardly relative to the bowl, (e) socket means in said driver means arranged to engage the projections on the bowl in an inward position of said driver means whereby the bowl is rotated by operation of said slide bar in one direction of its reciprocating movement and upon outward movement of said driver means out of engagement of said socket means with the projections, said driver means is movable with said bar in the other direction of reciprocating movement into a position for engagement of said socket means with a succeeding projection for further rotation of said bowl upon operation of said double acting means, (f) and second double acting means connected between said slide bar and said driver means for pivoting the latter between its inner and outer positions, (g) said socket means having a driving edge on each defining side thereof for driving the bowl in either direction of rotation as well as for holding the bowl from overrunning after each rotative function.

2. The power driven bowl rotating mechanism of claim 1 wherein said upright frame comprises a pair of upright end supports arranged to be secured at the bottom thereof to said base member ans secured together by a longitudinal connecting frame member adjacent the lower end thereof, said slide bar having slidable support between said upright end supports.

3. The power driven bowl rotating mechanism of claim 2 wherein said first double acting means is disposed between said upright end supports and below said slide bar.

4. The power driven bowl rotating mechanism of claim 1 wherein said driver means includes a pair of spaced arms having the pivot connection thereof on said slide bar adjacent one end of said arms, said socket means comprising notches in both of said arms.

5. The power driven bowl rotating mechanism of claim 4 including a connecting web secured between said spaced arms on each side of said socket means and forming said driving edges.

6. A power driven bowl rotating mechanism for use with rock crushers of the type having a base member and a bowl threadedly supported on the base member whereby upon rotation thereof the bowl is arranged to be raised or lowered, the bowl being of the type which has a plurality of projections secured in spaced relation around the periphery thereof, said power driven bowl rotating mechanism comprising (a) an upright frame arranged to be secured to the base member of a crusher, (b) a slide bar supported on said upright frame for horizontal slidable movement, (c) first double acting means connected between said upright frame and said slide bar and arranged to drive said slide bar longitudinally in reciprocating movement, (d) driver means pivotally mounted on said slide bar arranged for movement inwardly and outwardly relative to the bowl, (e) socket means in said driver means arranged to engage the projections on the bowl in an inward position of said driver means whereby the bowl is rotated by operation of said slide bar in one direction of its reciprocating movement and upon outward movement of said driver means out of engagement of said socket means with the projections, said driver means is movable with said bar in the other direction of reciprocating movement into a position for engagement of said socket means with a succeeding projection for further rotation of said bowl upon operation of said double acting means, (f) second double acting means connected between said slide bar and said driver means for pivoting the latter between its inner and outer positions, (g) an upright extension frame attachable to said slide bar and projecting above the latter, (h) and pivotally mounted auxiliary driver means on said extension frame arranged for engagement with the projections in an initial upper threaded engagement of said bowl when the projections are above said first mentioned driver means.

7. The power driven bowl rotating mechanism of claim 6 wherein said upright extension frame includes end members attachable to said slide bar and an upper connecting member secured between said end members, said auxiliary driver means being pivotally mounted on said connecting member.

8. The power driven bowl rotating mechanism of claim 6 wherein said auxiliary driver means is spring biased toward said projections and operates as a ratchet in longitudinal reciprocating movements of said slide bar to rotate said bowl.

9. A power driven bowl rotating mechanism for use with rock crushers of the type having a base member and a bowl threadedly supported on the base member whereby upon rotation thereof the bowl is arranged to be raised or lowered, the bowl being of the type which has a plurality of projections secured in spaced relation around the periphery thereof, said power driven bowl rotating mechanism comprising (a) an upright frame arranged to be secured to the base member of a crusher, (b) a slide bar supported on said upright frame for horizontal slidable movement, (c) first double acting means connected between said upright frame and said slide bar and arranged to drive said slide bar longitudinally in reciprocating movement, (d) driver means pivotally mounted on said slide bar arranged for movement inwardly and outwardly relative to the bowl, (e) socket means in said driver means arranged to engage the projections on the bowl in an inward position of said driver means whereby the bowl is rotated by operation of said slide bar in one direction of its reciprocating movement and upon outward movement of said driver means out of engagement of said socket means with the projections, said driver means is movable with said bar in the other direction of reciprocating movement into a position for engagement of said socket means with a succeeding projection for further rotation of said bowl upon operation of said double acting means, (f) second double acting means connected between said slide bar and said driver means for pivoting the latter between its inner and outer positions, (g) jam nut means arranged for threaded engagement with the bowl and arranged to be vertically abutted against the base member whereby to hold the bowl and base member in non-rotative connection when the threads of said jam nut means are forcefully jammed against the threads of the bowl, (h) fluid-operated cylinder means arranged to be connected between the base member and said jam nut means and arranged to drive said jam nut means rotatably into connecting and release positions, (i) said fluid-operated cylinder means being arranged to have at least two mounting positions on the base member for varying the drive stroke thereof.

* * * * *